United States Patent [19]

Worsham

[11] Patent Number: 4,718,202

[45] Date of Patent: Jan. 12, 1988

[54] METHOD AND APPARATUS FOR ROUNDING THE EDGES OF SEMICONDUCTIVE WAFERS

[75] Inventor: Daniel A. Worsham, San Jose, Calif.

[73] Assignee: Pacific Western Systems, Inc., Mountain View, Calif.

[21] Appl. No.: 410,812

[22] Filed: Aug. 23, 1982

Related U.S. Application Data

[63] Continuation of Ser. No. 117,012, Jan. 31, 1980, abandoned.

[51] Int. Cl.[4] ..... B24B 9/06

[52] U.S. Cl. ..... 51/283 E; 51/103 R; 51/104; 51/318

[58] Field of Search ..... 51/71, 74 R, 77 R, 103 R, 51/104, 215 AR, 215 R, 263, 283 R, 289 R, 289 S, 290, 292, 318; 409/132, 138; 198/625, 663

[56] References Cited

U.S. PATENT DOCUMENTS

| | | | |
|---|---|---|---|
| 417,733 | 12/1889 | Lumley | 51/103 R |
| 672,664 | 4/1901 | Bornemann | 51/103 R |
| 2,438,239 | 3/1948 | Toulmin | 51/289 S X |
| 2,486,750 | 11/1949 | Mason | 51/289 S X |
| 2,608,815 | 9/1952 | Graaf | 198/625 X |
| 3,054,496 | 9/1962 | Carter | 198/625 X |
| 3,186,134 | 6/1965 | Bonin | 51/283 E |
| 3,507,382 | 4/1970 | Wells | 198/625 |
| 3,791,508 | 2/1974 | Osborne et al. | 198/625 |

FOREIGN PATENT DOCUMENTS

| | | | |
|---|---|---|---|
| 921704 | 2/1973 | Canada | 51/289 S |

*Primary Examiner*—Robert P. Olszewski
*Attorney, Agent, or Firm*—Harry E. Aine

[57] ABSTRACT

In an apparatus for rounding the edges of semiconductive wafers, the wafers are loaded onto two parallel counter rotating screws one having a right hand thread and the other having a left hand thread. The grooves of respective ones of said screw engage the edges of the semiconductive wafer to be rounded. The grooves of the respective screws are of rounded cross-section and an abrasive slurry is introduced into the grooves to facilitate abrading of the edges of the wafers. A pressure roller engages the edges of the wafers and forces the wafers into the grooves to further facilitate rounding of the edges. Due to the action of the screws, the wafers, as they are being rounded are caused to traverse the length of the screws to provide a continuous processing of the wafers.

9 Claims, 7 Drawing Figures

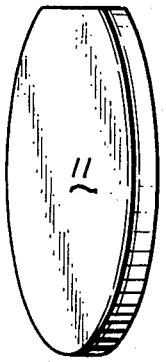
Fig_1
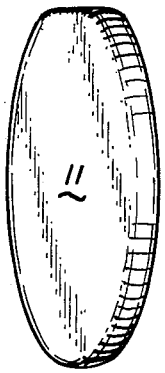
Fig_2
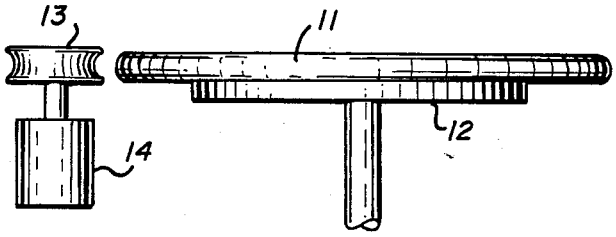
Fig_3 PRIOR ART
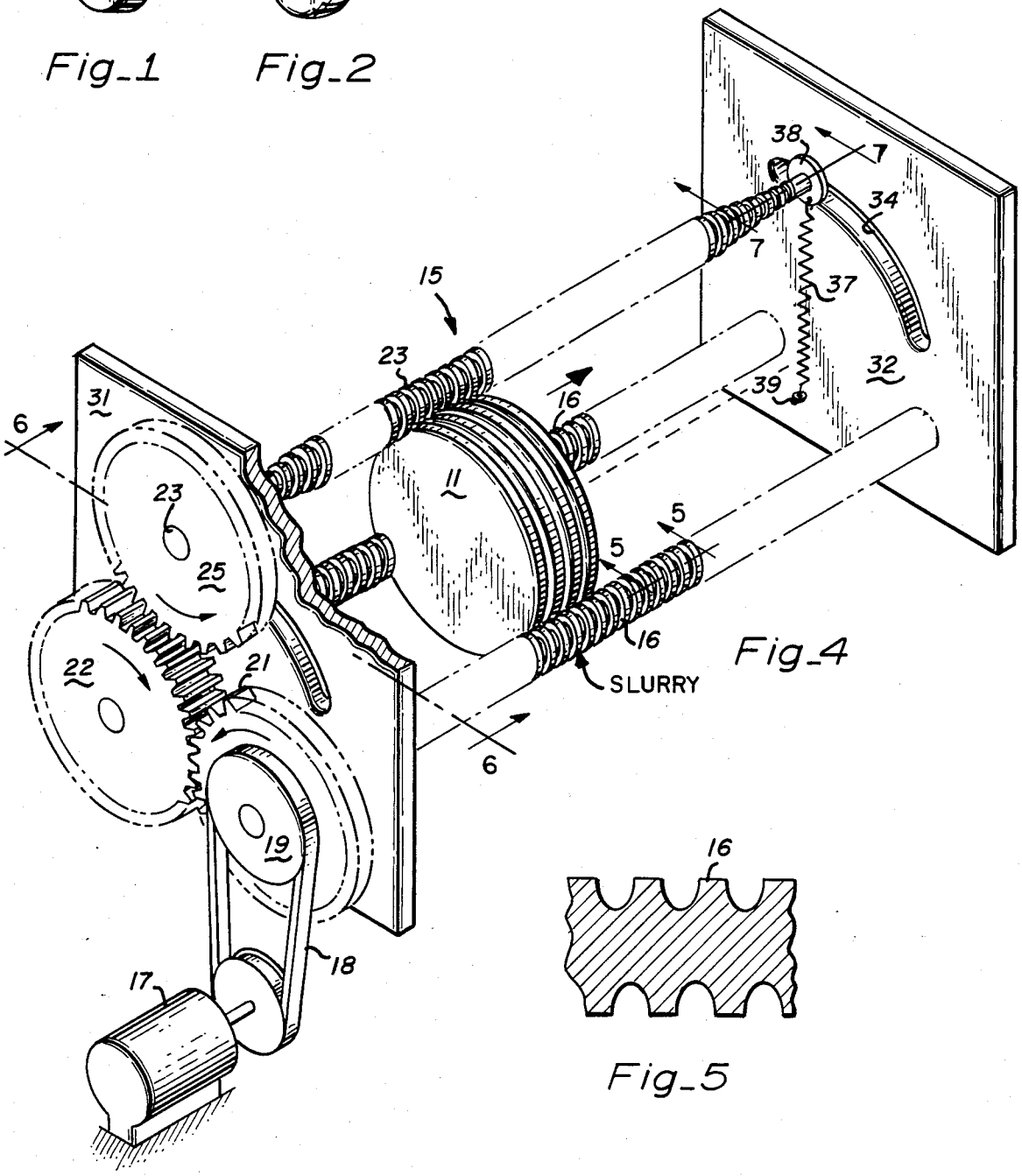
Fig_4
Fig_5

METHOD AND APPARATUS FOR ROUNDING THE EDGES OF SEMICONDUCTIVE WAFERS

This is a continuation, of application Ser. No. 117,012, filed Jan. 31, 1980, now abandoned.

BACKGROUND OF THE INVENTION

The present invention relates in general to method and apparatus for rounding the edges of semiconductive wafers to prevent undesired chipping and cracking thereof during handling and processing of the wafers in the production of semiconductive die.

DESCRIPTION OF THE PRIOR ART

Heretofore, the edges of semiconductive wafers have been rounded to prevent undesired chipping and cracking by mounting the wafer to a rotatable chuck and bringing a motorized grinding wheel having a rounded groove therein which receives the edge of the wafer into engagement with the edge of the wafer, thereby grinding the wafer so as to round its edge.

This prior method of rounding the edges of the semoconductive wafers is relatively time consuming and tedious and it is desired to provide an improved method more amenable to batch processing or continuous processing of the wafers.

SUMMARY OF THE PRESENT INVENTION

The principal object of the present invention is the provision of an improved method and apparatus for rounding the edges of semiconductive wafers, such method and apparatus being suitable for batch or continuous processing of the wafers.

In one feature of the present invention, the side edges of the wafers are introduced into a groove of a screw means so that as the screw means turns it advances the wafer in a continuous manner while abrading the side edges of the wafer for rounding same.

In another feature of the present invention, means are provided for pressing the side edges of the wafer into frictional engagement with the groove of the screw means so as to facilitate abrasion and rounding of the edges of the wafer.

In another feature of the present invention, an abrasive slurry is introduced into the groove of the screw means to facilitate abrasion and rounding of the side edges of the wafers being processed.

Other features and advantages of the present invention will become apparent upon a perusal of the following specification taken in connection with the accompanying drawings wherein:

BRIEF DESCRIPTION OF THE DRAWINGS

FIG. 1 is a perspective view of a wafer with unrounded side edges,

FIG. 2 is a view similar to that of FIG. 1 depicting a wafer with rounded side edges.

FIG. 3 is a side elevational view of a prior art apparatus for rounding the edges of the wafers, FIG. 4 is a perspective view of an apparatus for rounding the edges of the wafers and incorporating features of the present invention.

FIG. 5 is an enlarged sectional view of that portion of the structure of FIG. 4 taken along line 5—5 in the direction of the arrows.

DESCRIPTION OF THE PREFERRED EMBODIMENTS

Figure 6:
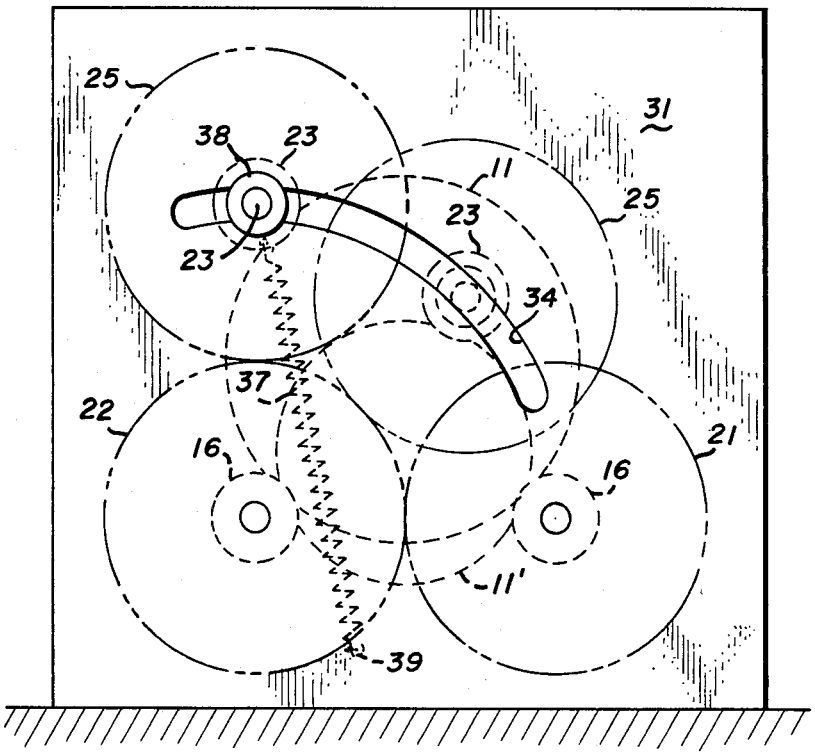
FIG. 6 is an end view, partially in phantom lines of the structure of FIG. 4 taken along line 6—6 in the direction of the arrows.

Referring now to FIG. 1, there is shown the conventional semiconductive wafer 11 utilized in the production of semiconductive devices. In a typical example, the wafer 11 has a diameter of between 1 and 6 inches and a thickness of 10 to 20 mills and includes an alignment flat comprising a chord removed from the wafer before the wafer is sliced from the boule to define certain crystallographic axes of the material.

One of the problems encountered in processing of semiconductive wafers is that unless the edges of the wafer are rounded, undesired chipping occurs during handling and processing of the wafers, such chipping deleteriously affects the devices, particularly those near the outer periphery of the wafer.

Accordingly, the wafers 11 have their side edges rounded to prevent the undesired chipping. This rounding is shown in FIG. 2.

Referring now to FIG. 3, there is shown the typical prior art grinding apparatus used for rounding the edges of the wafer 11. More particularly, the wafer 11 is mounted to a vacuum chuck 12 and spun while a grinding wheel 13 driven from a motor 14 is brought into grinding relation with the side edges of the wafer 11. The grinding wheel includes a groove formed therein of rounded cross section so as to grind the edges of the wafer in the desired rounded configuration.

The problem with this prior art arrangement for rounding the edges of the wafer is that it is relatively tedious and time consuming and does not lend itself well to batch or a continuous processing.

Referring now to FIG. 4, there is shown a wafer edge rounding apparatus 15 incorporating features of the present invention. More particularly, the wafer edge rounding machine 15 includes a pair of generally parallel screws 16 of equal pitch and spaced apart sufficiently so as to receive opposite side edges of the wafers 11 to be rounded. The thread portion of the screws 16, is more clearly depicted in FIG. 5 and includes a groove of rounded cross section conforming to the desired rounded configuration of the edges to be ground.

The screws 16 are driven from a motor 17, via a drive belt 18, driving a pulley 19, affixed to one of the screws. A drive gear 21 is affixed to the driven screw 16 and it meshes with a similar gear 22 carried from the other screw so that the screws are driven in synchronism in counter rotating directions. One of the screws has a right hand thread and the other has a left hand thread so that the screws drive in opposite senses on the wafer by frictional engagement with the side edges of the wafer and so that the wafer 11 is translated axially of the driven screws 16. A pressure screw 23 is positioned above the wafers 11, as loaded on the screws 16, so as to provide a slight pressure for urging the wafers 11 into frictional engagement with the grooves in respective screws 16. In addition, an abrasive slurry is introduced into the grooves of the screws 16 so as to facilitate abrading of the side edges of the wafers 11.

As the screws 16 are driven by the motor 17, the wafers advance from their point of introduction to the output end of the screws 16 so that in the time it takes for the wafers 11 to advance the length of the screws 16, the side edges of the wafers 11 are rounded in the process. As wafers exit at the output end of the screws 16, additional wafers are introduced at the input end of the screws 16. Thus, the wafer edge rounding machine 15 is suitable for continuous processing of the wafers 11.

The pressure screw 23 is made of a compressible material such as soft rubber and has a thread of the same pitch as that of the drive screws 16. In addition it has a decreasing diameter at both the input and output ends to facilitate loading and unloading of the wafers 11 into the machine 15 at input and output ends, respectively. The pressure screw 23, is driven from driven gear 22 via meshing gear 25 so that the wafers are driven axially of the screws 16 and 23 at precisely the same rate by each screw.

Figure 7:
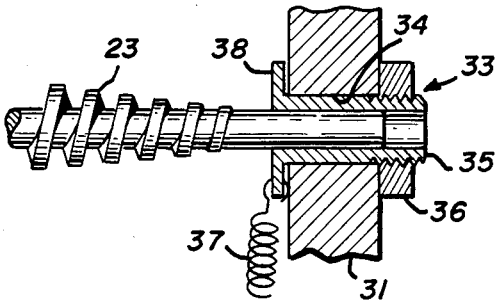
FIG. 7 is an enlarged sectional view of a portion of the structure of FIG. 4 taken in the direction of line 7—7 thereof.

The drive screws 16 and pressure screw 23 are mounted at their ends in bearing assemblies 33 contained in end plates 31 and 32. The bearing assemblies 33 (see FIGS. 6 and 7) for the pressure screw 23 are slideable within arcuate slots 34 through opposite end plates 31 and 32. The slots 34 have a radius of curvature centered on the axial center line of the drive screw 16 which is fixedly secured to gear 22. The bearing assemblies 33 each comprise a flanged sleeve 35 slideable within the respective slots 34. The sleeve 35 extends through the respective end plate 31 or 32 and is externally threaded to receive a nut 36 which when tightened down on the threaded sleeve 35 serves to clamp the bearing assembly 33 in place within the slot 34. A tension spring 37 is coupled at one end to the flanged portion 38 of the sleeve 35 and at the other end to the respective end plate 31 or 32 at 39.

The arcuate slots 34 and pressure screw 23 allow gear 25 to be angularly positioned about gear 22 in such a manner as to accommodate different sized wafers 11. For example, the nuts 36 are loosened to allow the bearing assemblies 33 to slide within the respective slots 34. The drive screw 23 and masking gear 25 is then rotated in the counter-clockwise direction about gear 22 to accommodate a relatively large wafer 11. With the wafers 11 loaded on the screws 16 and 23 the springs 37 provide a pressure tending to press the edges of the wafers 11 into engagement with respective grooves in the screws 16 and 23. With the proper adjustment of spring pressure, the nuts 36 are tightened and the wafer edge grinding machine 15 is now adjusted for the relatively large diameter wafers 11. When it is desired to utilize the edge grinding machine 15 for smaller diameter wafers 11' in position on the screws 16 and 23, the pressure screw 23 provides the correct pressure for pressing the edges of the wafers 11' into engagement with the grooves in the respective screws 16 and 23. The nuts 36 are then tightened and the machine is thus adjusted for operation with the smaller diameter wafers 11'.

What is claimed is:

1. In a method for rounding the edges of semiconductive wafers, the steps of:

loading the wafers onto a screw so that the edges of the wafers to be rounded ride in a groove of said screw; and turning said screw relative to said loaded wafers so as to rotate the wafer and to substantially abrade the edges of the loaded rotating wafers causing same to be rounded.

2. The method of claim 1 wherein said groove in said screw is of rounded cross section so as to cause the rounded edges of said loaded wafers to conform to the rounded contour of said groove.

3. The method of claim 1 including the step of applying a force to the loaded wafers to force their edges into frictional engagement with the walls of said groove in said screw.

4. In a method for rounding the edges of semiconductive wafers, the steps of:

loading the wafers onto a screw so that the edges of the wafers to be rounded ride in a groove of said screw;

turning said screw relative to said loaded wafers so as to rotate the wafer and to substantially abrade the edges of the loaded wafers causing same to be rounded; and introducing an abrasive slurry into the groove of said screw to facilitate abrasion of the edges of the loaded wafers to be rounded.

5. In an apparatus for rounding the edges of semiconductive wafers:

screw means having threads dimensioned to receive the marginal edge of essentially only individual ones of the wafers to be ground and which are free to rotate;

means for turning said screw means relative to said wafer so as to rotate said wafer about an axis of rectilinear translation of the wafer and to substantially abrade the edges of the loaded wafers causing same to be rounded;

said screw means including a pair of generally parallel rotating screw means of left and right handed threads respectively;

means for counter rotating said screw means so as to cause the loaded wafers to travel axially of said rotating screw means along said axis of rectilinear translation to facilitate batch processing of semiconductive wafers to be rounded; and means for introducing an abrasive slurry into said thread of said screw means to facilitate abrasion of the edges of the loaded wafers.

6. In an apparatus for rounding the edges of semiconductive wafers;

screw means having a thread groove to receive the marginal edges of the wafers to be rounded;

means for turning said screw means relative to said wafer so as to rotate the wafer about an axis parallel to the axis of revolution of said screw means to produce frictional engagement between said thread groove and the peripheral edge of the wafer for driving said wafer in opposite rotational senses at spaced peripheral portions of the wafer to substantially abrade the edges of the loaded wafers causing same to be rounded;

said screw means including a pair of generally parallel rotating screw means;

said screw means having said thread groove arranged so as to cause the wafer to travel axially of said rotating screw means to facilitate batch processing of semiconductive wafers to be ground; and pressure roller means having an axis of rotation generally parallel to that of said screw means for engaging the edges of the loaded wafers for forcing the edges of the loaded wafers into frictional engagement with the walls of said groove in said screw means.

7. In an apparatus for rounding the edges of semiconductive wafers:

screw means having threads dimensioned to receive the marginal edges of essentially only individual ones of the wafers to be ground and which are free to rotate.

means for turning said screw means relative to said wafer so as to rotate said wafer about an axis of rectilinear translation and to substantially abrade the edges of the loaded wafers causing same to be rounded;

said screw meaens including a pair of generally parallel rotating screw means of left and right handed threads respectively; and means for counter rotating said screw means so as to cause the loaded wafers to travel axially of said rotating screw means to facilitate batch processing of semiconductive wafers to be rounded.

8. The apparatus of claim 7 wherein said thread in said screw means is of a rounded cross section so as to cause the rounded edges of said loaded wafers to conform to the rounded contour of said thread.

9. The apparatus of claim 7 including means for applying a force to the loaded wafers to force the edges of the loaded wafers into frictional engagement with the walls of said thread in said screw means.

* * * * *